US006086466A

United States Patent [19]

Tasin et al.

[11] Patent Number: 6,086,466

[45] Date of Patent: Jul. 11, 2000

[54] CENTRIFUGAL EXPANSION ROLLER FOR SANDING MACHINES

[75] Inventors: Claudio Tasin, Milan; Alberto Felici, Turin, both of Italy

[73] Assignee: Unibase S.p.A., Milan, Italy

[21] Appl. No.: 09/165,377

[22] Filed: Oct. 2, 1998

[51] Int. Cl.[7] ..... B24D 17/00; B24D 9/02

[52] U.S. Cl. ..... 451/495; 451/504; 451/506

[58] Field of Search ..... 451/495, 504, 451/506

[56] References Cited

U.S. PATENT DOCUMENTS

| | | | |
|---|---|---|---|
| 1,917,303 | 7/1933 | Hope | 451/506 |
| 3,166,876 | 1/1965 | Manchester | 451/507 |
| 3,339,319 | 9/1967 | Schuster et al. . | |
| 4,291,507 | 9/1981 | Littlehorn, Jr. . | |
| 5,567,197 | 10/1996 | Evensen | 451/506 X |
| 5,672,096 | 9/1997 | Amarosa et al. | 451/506 X |
| 5,890,953 | 4/1999 | Evensen | 451/504 |

FOREIGN PATENT DOCUMENTS

| | | |
|---|---|---|
| 32 43 598 | 5/1984 | Germany . |
| 8797 | 4/1912 | United Kingdom . |

OTHER PUBLICATIONS

"Expandable Contact Wheel", p. 62, Mechanical Engineering, vol. 99, No. 4, Apr. 1977.

*Primary Examiner*—Timothy V. Eley
*Attorney, Agent, or Firm*—Young & Thompson

[57] ABSTRACT

A centrifugal expansion roller (1) for sanding machines, particularly floor sanders, of the type consisting of a metal core (3) with an outer elastomeric annular cover (4). The entire surface of the cover is provided with a plurality of longitudinal slits (5, 8) extending into the annular cover along non-radial planes. The slits (5, 8) are formed along trajectories which have opposite ends that are inclined in opposite directions in respect of a longitudinal generatrix of the surface of the cover.

6 Claims, 2 Drawing Sheets

CENTRIFUGAL EXPANSION ROLLER FOR SANDING MACHINES

BACKGROUND OF THE INVENTION

The present invention concerns an improved centrifugal expansion roller for sanding machines, particularly floor sanders.

In machines for sanding floors there are known to be centrifugal expansion rollers provided with an endless sand belt.

Such centrifugal expansion rollers consist of a metal core (generally of aluminium) and of an outer elastomeric annular cover (usually of rubber) fixed to the core. A plurality of longitudinal slits are formed on the outer surface of said annular cover, such slits extending along non-radial planes and having a depth such as to leave an uncut elastomer portion towards the core.

While working, during rotation of the roller, the rubber portions between the slits tend—due to centrifugal force—to deform in a radial sense, thereby dragging the sand belt.

In respect of the conventional sand rollers with sand (abrasive) strips fixed by suitable means, the centrifugal rollers have the advantage of being very easy to produce, while the sand belt is easy to mount.

Nevertheless, said rollers also involve some significant drawbacks.

In fact, each slit on the roller surface presses the abrasive onto the floor simultaneously along the whole generating line of said roller, which consequently moves forward slit by slit, leading to an unsatisfactory quality of the sanded surfaces and causing a loud noise.

To try and overcome the above drawbacks, the centrifugal rollers have been produced with slits extending in a helicoidal sense. But this system—when the roller is pressed onto the floor with the force required to do the sanding—produces an axial component, which tends to drive the sand belt out of the roller hence making this solution unacceptable.

SUMMARY OF THE INVENTION

The present invention now faces and solves the problem by providing an improved centrifugal expansion roller for sanding machines, particularly floor sanders—of the type consisting of a metal core with an outer elastomeric annular cover provided, over its entire surface, with a plurality of longitudinal slits extending into the annular cover along non-radial planes, wherein the slits are formed along trajectories which have opposite ends that are inclined in opposite directions in respect of a longitudinal generatrix of the surface of the cover.

Suitably, said trajectories may correspond to continuous curved lines, tangent to said generating lines in correspondence of the central directrix of the roller surface, or else they may correspond to straight lines, extending from the central directrix of the roller surface with an opposite inclination in respect of said generating lines.

With rollers thus conceived, the axial component produced on one half of the roller is neutralized by that produced on the other half thereof, whereby the sand belt always remains axially balanced. Moreover, since each one of the inclined slits—such as formed onto the surface of the roller according to the invention—presses the abrasive onto the floor in a gradual way, the quality of the floor surface always turns out to be excellent and the noise is suitably repressed.

BRIEF DESCRIPTION OF THE DRAWINGS

The invention is now described in further detail, with reference to some preferred embodiments thereof illustrated by way of example on the accompanying drawings, in which.

DESCRIPTION OF THE PREFERRED EMBODIMENTS

Figure 1:
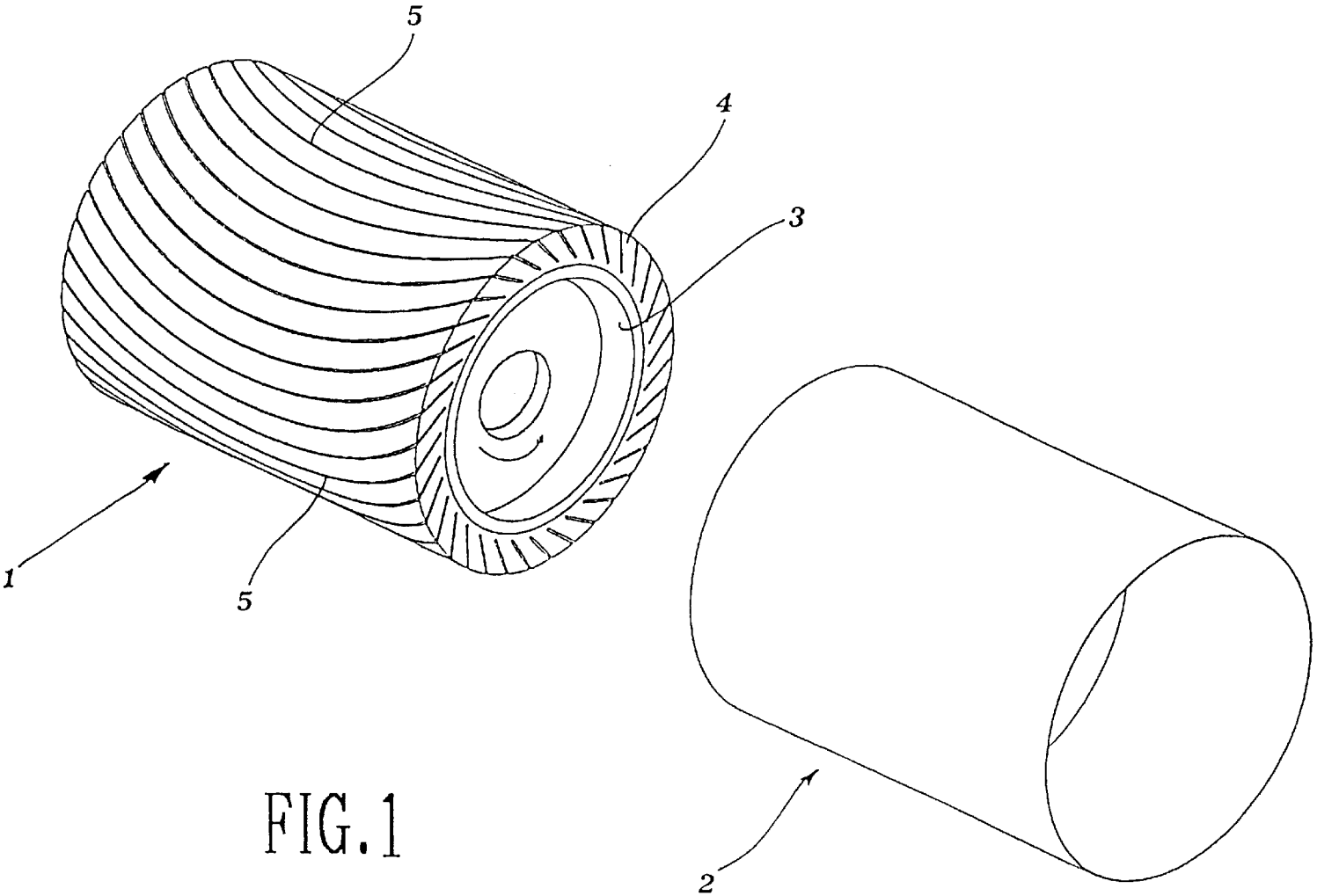
FIG. 1 is a diagrammatic view of a first embodiment of the centrifugal expansion roller according to the invention.

With reference to FIG. 1 of the drawings, a centrifugal expansion roller 1—on which is meant to be mounted an endless sand belt 2 for the sanding, for example, of floors by means of sanding machines—comprises a stiff metal core 3, with an outer resilient elastomeric cover 4 having an annular section.

According to a first embodiment of the invention, a plurality of longitudinal slits 5 is formed onto the surface of the outer elastomeric annular cover 4, said slits 5 extending along non-radial planes according to trajectories corresponding to curved lines, tangent to the generating lines in correspondence of the central directrix of said surface and inclined in opposite directions in respect of said generating lines.

Figure 2:
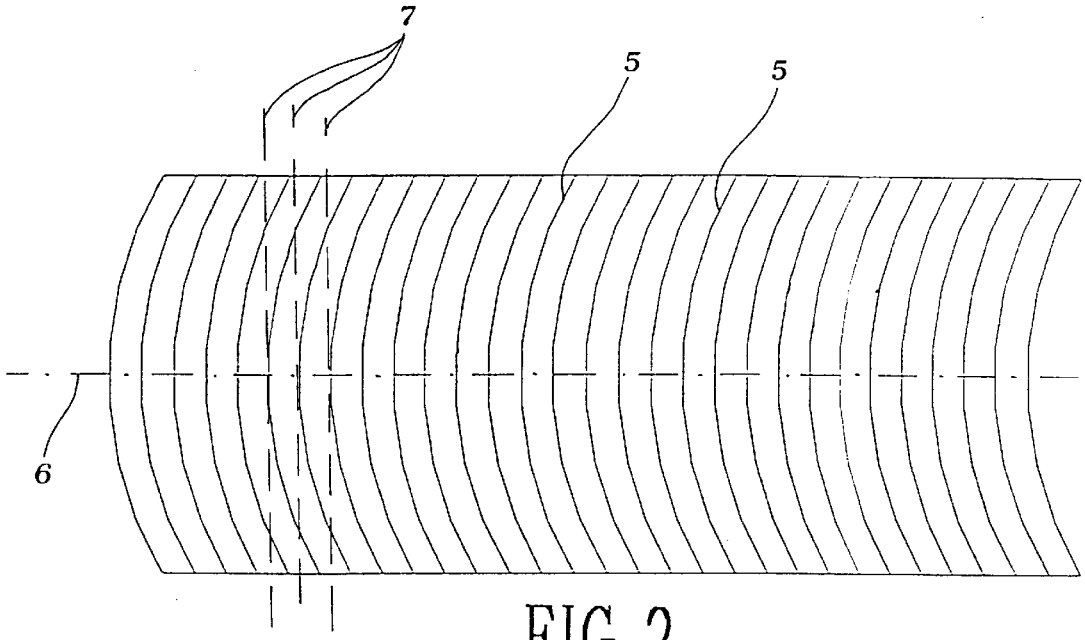
FIG. 2 illustrates the development of the surface of the roller shown in FIG. 1.

The surface development of the outer elastomeric annular cover 4 of the roller 1 is illustrated in FIG. 2, which shows the central directrix 6 and some generating lines 7 of the cylindrical surface of said cover onto which are formed the slits 5.

Figure 3:
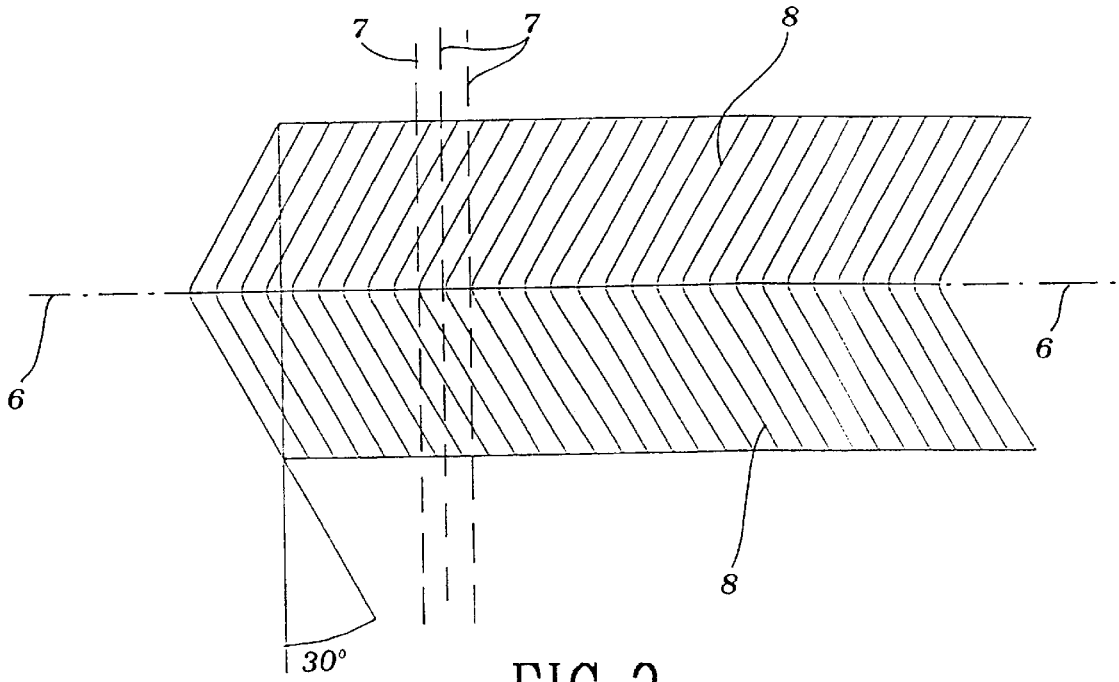
FIG. 3 illustrates the development of the surface of a second embodiment of the roller according to the invention.

FIG. 3 illustrates the surface development of the outer elastomeric annular cover 4 in a second embodiment of the roller 1 according to the invention, wherein a plurality of longitudinal slits 8 is formed along non-radial planes of the cylindrical surface of said cover 4, according to trajectories corresponding to straight lines extending, with an opposite inclination in respect of the generating lines 7, from the central directrix 6 of said surface where they are mutually radiused. In the embodiment of FIG. 3, the inclination in respect of the generating lines 7 is suitably of 30°.

It is anyhow understood that there can be other embodiments of the centrifugal expansion roller according to the invention, differing from those described and illustrated. In particular, the outer elastomeric annular cover of said roller can be provided with slits formed along trajectories differing from those described heretofore, without thereby departing from the scope of the present invention.

What is claimed is:

1. A centrifugal expansion roller for a sanding machine, comprising:

a metal core with an elastomeric annular cover having an outer cylindrical surface with a plurality of longitudinal slits therein that extend into said annular cover on non-radial planes and that are provided over an entirety of said outer cylindrical surface, each of said slits having a first end part and a second end part opposite said first end part, said first end part being inclined relative to a longitudinal generatrix of said outer cylindrical surface and said second end part being inclined relative to the longitudinal generatrix of said outer cylindrical surface generally opposite to the inclination of said first end part.

2. The roller of claim 1, wherein each of said slits is arcuate and has a central part that is parallel to the longitudinal generatrix.

3. The roller of claim 1, wherein said first end part of said slit is straight and said second end part of said slit is straight, and wherein said first and second end parts meet in a central portion of said cover.

4. The roller of claim 3, wherein an angle of about 120° separates said first and second end parts where they meet in said central portion of said cover.

5. The roller of claim 1, wherein said slits are parallel to each other.

6. A centrifugal expansion roller for a sanding machine, comprising:

a metal core with an elastomeric annular cover having an outer cylindrical surface with a plurality of longitudinal slits therein that (a) are continuous curved lines, (b) extend into said annular cover on non-radial planes, and (c) are provided over an entirety of said outer cylindrical surface, each of said slits having a first end part, a second end part opposite said first end part, and a central part between said first and second end parts, said first end part being inclined relative to a longitudinal generatrix of said outer cylindrical surface and said second end part being inclined relative to the longitudinal generatrix of said outer cylindrical surface generally opposite to the inclination of said first end part, and said central part being parallel to the longitudinal generatrix.

* * * * *